US011519198B2

(12) United States Patent
Weichsel

(10) Patent No.: US 11,519,198 B2
(45) Date of Patent: Dec. 6, 2022

(54) MOTOR VEHICLE DOOR LOCK, MORE PARTICULARLY HOOD LOCK

(71) Applicant: Kiekert AG, Heiligenhaus (DE)

(72) Inventor: Ulrich Weichsel, Duisburg (DE)

(73) Assignee: Kiekert AG, Heiligenhaus (DE)

( * ) Notice: Subject to any disclaimer, the term of this patent is extended or adjusted under 35 U.S.C. 154(b) by 254 days.

(21) Appl. No.: 16/485,204

(22) PCT Filed: Jan. 24, 2018

(86) PCT No.: PCT/DE2018/100051

§ 371 (c)(1),
(2) Date: Aug. 12, 2019

(87) PCT Pub. No.: WO2018/145692

PCT Pub. Date: Aug. 16, 2018

(65) Prior Publication Data

US 2019/0368224 A1 Dec. 5, 2019

(30) Foreign Application Priority Data

Feb. 13, 2017 (DE) ..... 10 2017 102 813.7

(51) Int. Cl.
*E05B 17/00* (2006.01)
*E05B 81/08* (2014.01)
(Continued)

(52) U.S. Cl.
CPC ..... *E05B 17/0037* (2013.01); *E05B 81/08* (2013.01); *E05B 81/70* (2013.01);
(Continued)

(58) Field of Classification Search
CPC ..... E05B 17/0037; E05B 81/08; E05B 81/70; E05B 83/24; E05B 2015/0048;
(Continued)

(56) References Cited

U.S. PATENT DOCUMENTS

2006/0006669 A1 1/2006 Nelsen
2018/0073283 A1* 3/2018 Kim ..... E05B 81/72

FOREIGN PATENT DOCUMENTS

DE 1801154 4/1970
DE 2138677 A1 2/1972
(Continued)

OTHER PUBLICATIONS

International Search Report and Written Opinion for corresponding Patent Application No. PCT/DE2018/100051 dated Apr. 19, 2018.

*Primary Examiner* — Christine M Mills
*Assistant Examiner* — Yahya Sidky
(74) *Attorney, Agent, or Firm* — Renner, Otto, Boisselle & Sklar, LLP

(57) ABSTRACT

A motor vehicle door lock, more particularly a hood lock. The basic structure of the hood lock is composed of a raising mechanism, for a locking bolt or another stop part, on a hood. An actuating spring acting on the raising mechanism is also provided, in addition to a sensor for sensing the position of the hood. According to the invention, an additional spring is provided which raises the hood if the actuating spring breaks down and/or malfunctions.

16 Claims, 2 Drawing Sheets

Figure 1:
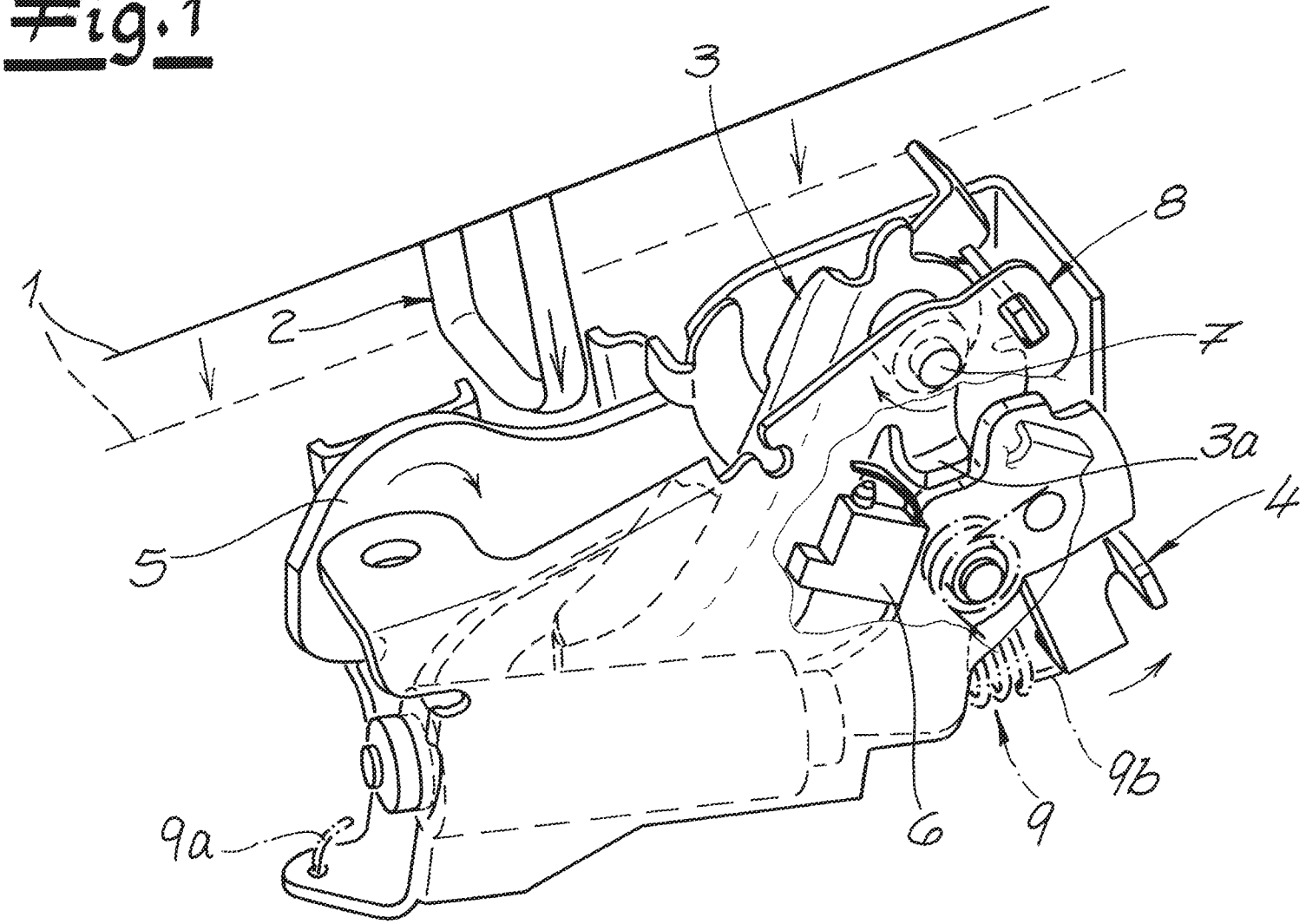

(51) Int. Cl.
*E05B 81/70* (2014.01)
*E05B 83/24* (2014.01)
*E05B 15/04* (2006.01)

(52) U.S. Cl.
CPC ..... *E05B 83/24* (2013.01); *E05B 2015/0448* (2013.01); *E05Y 2900/536* (2013.01)

(58) Field of Classification Search
CPC ..... E05B 2015/0448; E05Y 2900/536; Y10S 292/14; B62D 25/10; B62D 25/105
USPC ..... 296/193.11; 292/201, 216, DIG. 14
See application file for complete search history.

(56) References Cited

FOREIGN PATENT DOCUMENTS

| | | | | | |
|---|---|---|---|---|---|
| DE | 10019668 | A1 * | 10/2001 | ..... | E05B 81/20 |
| DE | 10019668 | A1 | 10/2001 | | |
| DE | 102005057820 | | 6/2007 | | |
| DE | 102010029816 | A1 | 12/2011 | | |
| DE | 102011121542 | A1 | 6/2013 | | |
| EP | 1710378 | A2 | 10/2006 | | |
| EP | 2400086 | A2 | 12/2011 | | |
| FR | 2848235 | A1 | 6/2004 | | |
| FR | 2889230 | A1 | 2/2007 | | |
| FR | 2981974 | | 5/2013 | | |
| KR | 101542689 | B1 * | 8/2015 | ..... | E05B 81/20 |

* cited by examiner

MOTOR VEHICLE DOOR LOCK, MORE PARTICULARLY HOOD LOCK

The invention involves a motor vehicle door lock, particularly a hood lock, with a raising mechanism for a locking bolt or another stop part on a hood, also with at least one actuating spring, acting on the raising mechanism, and with a sensor for sensing the position of the hood.

A motor vehicle door lock of the initially described structure is known from practice. Comparable designs are described within the scope of EP 1 710 378 A2. Here, there is a stop device which is equipped with a swivel part with which the locking bolt or the other stop part comes into contact when closing the door or hood that can be closed by the related motor vehicle door lock. When closing the door or hood further, a damping element or spring element on the swivel part causes a force or a torque, which assists in damping or slowing down an energetic closing of the door or hood.

Furthermore, DE 10 2010 029 816 A1, among others, has created awareness of a spring device on a swivelable flap of a motor vehicle, which is equipped with a gas spring and an additional spring between the body of the motor vehicle and the flap. In addition, an actuator can be activated by a sensor device, which can assist in raising the front flap to a pedestrian protection position before an impact, for example, of a pedestrian on the front flap. The additional spring ensures that, in the event of a fault in which the gas spring has a lower gas pressure or none, the front flap is held in the pedestrian protection position provided.

In the case of hoods, such as front hoods or tailgates, it is fundamentally important to clearly distinguish between an open and closed position. Thus if the front flap is not properly closed, for example, there is a risk of the front flap swiveling up out of a pre-ratchet position through the impacting air flow and completely obscuring the driver's view. This is dangerous and liable to lead to accidents.

Of course, it is also important that side doors in motor vehicles safely assume their closed position. Only then can additional devices such as side impact protection, side airbags, etc. be fully effective and optimally protect the vehicle occupants. However, in contrast to side doors, the problem with front hoods or tailgates is that the closed state can also be wrongly displayed.

This can be attributed to the fact that, for example, the weight of a front hood causes it to impinge on the sensor for the position sensing of the hood or for sensing the closing position, even if the actuating spring no longer works or does not work reliably. The invention intends to provide an overall remedy here.

The invention is based on the technical problem of further developing a motor vehicle door lock of this type in a manner that will enable the flawless position sensing of the hood by means of the sensor.

To solve this technical problem, we have a class-specific motor vehicle door lock in the context of the invention, which is characterized by the fact that, in addition to the actuating spring, it has an additional spring which raises the hood if the actuating spring breaks down and/or malfunctions. The raising movement of the hood is carried out at least to the extent that the sensor does not generate the "closed" message for the hood.

According to the invention, if the actuating spring breaks down and/or malfunctions, the additional spring can assume the function of the actuating spring, at least to such an extent that the sensor for the position sensing of the hood does not, for example, emit a signal along the lines of "hood closed" to a control unit.

In this case, the additional spring, as a replacement for the actuating spring, ensures instead that the hood is raised, even if only slightly. This means, for example, that a control unit and thus a driver are reliably informed that the relevant hood is not closed and must be closed before departure. This is achieved even if the actuating spring as such is broken, detached from its anchorage, or otherwise impaired in terms of its functioning. It is always ensured that the sensor for the position sensing of the hood does not wrongly detect a closed position of the hood and report it to the control unit. These are the fundamental advantages.

The actuating spring can generally be formed as a tension spring. Here, you usually work with a coil spring or helical coil spring. For this purpose, the tension spring is generally attached in a fixed manner at one end to a lock housing. On the other hand, the other end of the tension spring usually engages in an actuator.

In addition to the aforementioned actuator, the raising mechanism usually also has a position element. The design is frequently created in such a manner that the actuator and the position element are flexibly interconnected. The change of the hood from its open or raised position to the closed position corresponds in this context to the fact that the angle between the actuator and the position element is increased. At the same time, this opening between the actuator and the position element causes the tension spring to be deflected.

As soon as the hood leaves its closed position and is raised, the tension spring can relax. Here, the angle is reduced between the actuator and the position element, which corresponds to the desired raising of the hood. To continue ensuring a flawless operational reliability in the event of a break down of the actuating spring, the raising mechanism is equipped with the auxiliary spring.

In this context, it has proved successful if the additional spring is designed as a leg spring. The leg spring has two spring legs, which are connected by a winding spring section. Thus there is a typically acute angle between the two spring legs.

If the actuating spring fails, the two leg springs open and ensure that the hood is still raised. For this purpose, the leg spring is connected to the actuator with one spring leg and to the position element with its other spring leg and ensures the appropriate opening. The opening between the actuator and the position element corresponds again to the fact that the hood is raised, at least to the extent that the sensor for the position sensing of the hood does not wrongly indicate its closed state.

The position element usually interacts with the relevant sensor for this purpose. For this purpose, the position element is advantageously equipped with an actuating nose, which impinges on the relevant sensor at least in the closed state of the hood. The sensor is usually a robust and cost-effective switch, particularly a microswitch. A microswitch is a switch that is used in many ways for positioning in motor vehicle door locks because of its dimensions in the millimeter range. Of course, other sensors, such as a distance sensor or the like, can also be used.

The locking bolt or the other stop part on the hood generally interacts directly or indirectly with the actuator and/or the position element. The locking bolt or the other stop part usually acts on a swivel part, similar to that already described in the innovative state of the art according to EP 1 710 378 A1. The locking bolt or the stop part ensures that the swivel part performs a swivel movement during the closing process of the hood. The swivel movement of the swivel part is transferred to the actuator. In addition, the swivel part acts on the position element. As a result of this, the position element and the flexibly connected actuator are opened towards each other. At the same time, the actuating spring is tensioned.

Since the position element performs a swivel movement during this process of closing the hood, the actuating nose on the position element can impinge on the sensor or the switch as soon as the hood assumes its closed position. In the event that the actuating spring fails, the additional spring alternatively ensures the described opening and thus also that the sensor or switch indicates the closed position of the hood as soon as it has actually been assumed.

As a result, the sensor reliably indicates the position of the hood. In particular, a clear distinction can be made between the closed and the raised state. This is important in that the hood, for example, in a raised state, is usually secured by means of a fork latch or a snap hook, which holds the locking bolt in the then assumed pre-ratchet position or snap position. However, this situation must be reliably communicated to a driver in order to prevent unintentional driving. All of this is achieved according to the invention even if the actual actuating spring has failed and its function is assumed by the additional spring provided. These are the fundamental advantages.

Figure 2:
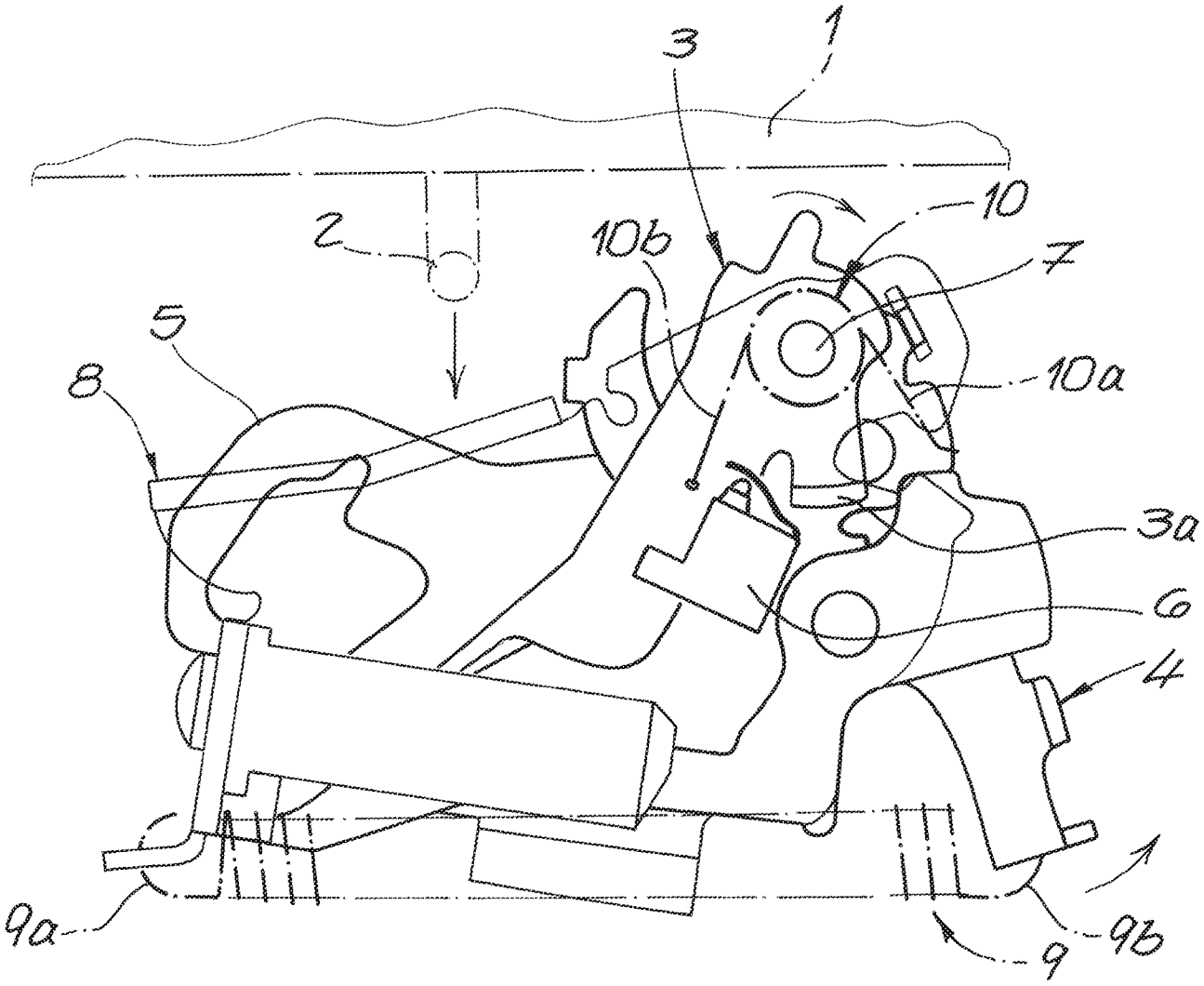

The invention is explained in further detail hereafter on the basis of a drawing which only constitutes an exemplary embodiment. The following are shown:

FIGS. 1 and 2 the inventive motor vehicle door lock in different views or functional positions.

The figures show a motor vehicle door lock and particularly a hood lock. The relevant lock actually serves to define a hood or front hood 1 on a body that is not shown in more detail in the exemplary embodiment. The hood 1 has a locking bolt 2. The locking bolt 2 interacts with a locking mechanism not shown in more detail in the figures, which consists of a catch designed as a fork latch and at least one pawl. There is also a snap hook or catch hook which holds the hood 1 in the raised position. The snap hook or catch hook is not shown, like the locking mechanism, but it engages the locking bolt 2.

In addition, there is an explicitly drawn raising mechanism 3, 4, 5 in the figures. The raising mechanism 3, 4, 5 ensures that the locking bolt 2 and the hood 1 are raised in relation to the body if, for example, the locking mechanism that is not explicitly shown is opened by means of a handle provided inside the motor vehicle or the like. This does not apply to the catch hook engaging in this case, which the locking bolt 2 secures in the position represented by a continuous line in FIG. 1.

The catch hook is not shown, like the locking mechanism. As usual, this catch hook must be manually removed by a driver in order to be able to open the hood or front hood 1 in its entirety. Furthermore, a sensor is provided for the position sensing of the hood 1. Sensor 6 enables the determination of whether the hood 1 is in its closed position in relation to the body. The closed position is usually also implemented by a driver by manually pressing down the hood 1.

For this purpose, the driver may press down the hood 1 to such an extent that it assumes its completely closed position in relation to the body, as shown by the dotted lines in the figures. In principle, however, it is also possible for the hood 1 to be dropped from its open position, for example, and reach its closed position via gravity. In both cases, the sensor 6 reports a corresponding closing signal to a control unit that is not explicitly shown, but which is connected to the sensor 6.

The raising mechanism 3, 4, 5 for the locking bolt 2 or another stop part on the hood 1 consists of a position element 3 and an actuator 4 in the exemplary embodiment. The two aforementioned elements 3, 4 are flexibly interconnected. A common axis or rotary axis 7 is provided for this purpose. The axis or rotary axis is defined by the strong bolt of one of the two elements 3, 4, which is set in a lock housing 8 or in an otherwise fixed manner.

The actuator 4 is applied by means of an actuating spring 9. In the exemplary embodiment, the actuating spring 9 is a coil spring or tension spring. The actuating spring 9 is attached with its one end 9*a* to the lock housing 8 and is thus attached in a fixed manner. The other end 9*b* of the actuating spring 9, on the other hand, is fitted to the actuator 4.

The raising mechanism 3, 4, 5 also has a swivel part 5 in addition to the position element 3 and the actuator 4. The swivel part 5 interacts with the locking bolt 2 on the hood 1. As soon as the hood 1 is pressed down in relation to the motor vehicle body, starting from the continuously drawn and raised position according to the representation in FIG. 1 in the direction of the arrow for closing the hood, this results in the swivel part 5 performing a swivel movement, namely in a clockwise direction around an axis that is not explicitly shown according to the representation in FIG. 1. At the same time, the swivel movement of the swivel part 5 leads to the position element 3 or the position lever 3 realized at this point performing a clockwise movement around the axis 7, which is also indicated in FIG. 1. The position element or the position lever 3 engages with a boom in a guide in the swivel part 5 and is thereby swiveled clockwise.

The closing movement of the hood 1, which is realized in this manner, results in the actuating nose 3*a* on the position element or position lever 3 actuating the sensor 6, which is designed as a switch. As soon as the hood 1 has assumed its completely closed position in relation to the car body, this closed state is detected by the sensor or switch 6 and is transmitted to the control unit that is not explicitly shown. At the same time, the swivel movement of the swivel part 5, which takes place during the closing process, ensures that the actuator 4, in comparison to the axis 7 shared with the position element 3, performs the counterclockwise movement that is also indicated in FIG. 1. During this process, the spring end 9*b* of the actuating spring 9 is driven, so that the actuating spring 9 is tensioned overall.

If the actuating spring 9 breaks or one of the spring ends 9*a* or 9*b* is disconnected, the position element 3 may still be swiveled as described and the actuating nose 3*a* may impinge on the sensor or switch 6. As a result of this, the sensor 6 may report a wrongly emitted "closed" signal to the control unit in such a case. The aim of preventing the latter issue resulted in the realization of the additional spring 10 according to the invention, which is particularly evident in FIG. 2 and which assumes the function of the actuating spring 9 in this case. The additional spring 10 is assigned to the raising mechanism 3, 4, 5 or interacts with this, comparable to the actuating spring 9.

The additional spring 10 actually ensures that the hood 1 is still raised in the event of break down and/or a malfunction of the actuating spring 9. At the same time, the sensor or switch 6 is not wrongly impinged in the event of a break down of the actuating spring 9. For this purpose, the additional spring 10 for the raising mechanism 3, 4, 5 is designed in total as a leg spring. It is evident that the leg spring has two spring legs 10*a*, 10*b*, which are connected to a common winding spring section that also connects the two spring legs 10*a*, 10*b* to each other. The leg spring is connected with its one spring leg 10*a* to the actuator 4. On the other hand, the other spring leg 10*b* of the leg spring impinges on the position element 3.

If, as previously described in the closing process, the closing bolt 2 impinges on the swivel part 5, thus opening the position element 3 and the actuator 4 with respect to the angle included between them, this results simultaneously in the leg spring intermediated between the two aforementioned elements 3, 4 also being opened in the closed state of the hood 1 in relation to the body and thus being tensioned. If the actuating spring 9 breaks down, the additional spring 10 thus ensures that the position element 3 and the actuator 4 are moved again towards each other by means of the additional spring 10. The additional spring 10 relaxes in the process. This then results directly in the raising of the hood 1 in such a case, and thus also the swiveling of the position element 3 in a counterclockwise direction around the axis 7 that is shared with the actuator 4. As a result, the actuating nose 3*a* on position element 3 cannot impinge on the sensor or switch 6. This means that the additional spring 10 prevents a signal, indicating a closed position of the hood 1 in relation to the body, from being wrongly transmitted by the sensor or switch 6 to the control unit in the event of break down of the actuating spring 9.

It is ensured instead in the context of the invention that by the return 5 to the additional spring 10, the sensor or switch 6 correctly assumes the position assumed by the hood 1. In particular, a wrongly indicated closed position of the hood 1 is prevented. These are the fundamental advantages.

The invention claimed is:

1. A motor vehicle door lock for a hood, the motor vehicle door lock comprising:

a raising mechanism for a locking bolt or stop part on the hood, wherein the raising mechanism includes an actuator and a position element, at least one actuating spring configured to act on the raising mechanism to raise the hood, a lock housing, wherein the at least one actuating spring is a tension spring and has one end fixed to the lock housing and another end connected to the actuator, a sensor for position sensing of the hood, wherein the position element is configured to engage the sensor when the hood is in a closed position and the at least one actuating spring is tensioned, wherein the sensor is disengaged by the position element when the hood is raised by the at least one actuating spring, and an additional spring that flexibly interconnects the actuator and the position element, wherein the additional spring is configured to move the actuator and the position element toward each other which raises the hood in the event of break down and/or a malfunction of the at least one actuating spring to prevent the position element from engaging the sensor, wherein the additional spring is a leg spring having one spring leg that is directly connected to the actuator and another spring leg that directly impinges on the position element.

2. The motor vehicle door lock according to claim 1, wherein the locking bolt or stop part on the hood directly or indirectly interacts with the actuator and/or the position element.

3. The motor vehicle door lock according to claim 1, wherein the position element has an actuating nose which impinges on the sensor at least in the closed position of the hood.

4. The motor vehicle door lock according to claim 1, wherein the sensor is a switch.

5. The motor vehicle door lock according to claim 4, wherein the switch is a microswitch.

6. The motor vehicle door lock according to claim 1, wherein the position element and the actuator are rotatable about a common axis.

7. The motor vehicle door lock according to claim 6, wherein the common axis is defined by a bolt of one of the position element and the actuator, wherein the bolt is fixed to the lock housing.

8. The motor vehicle door lock according to claim 1, wherein the raising mechanism includes a swivel part that directly engages the locking bolt or stop part.

9. The motor vehicle door lock according to claim 8, wherein during a closing movement of the hood, the actuator is moved in response to movement by the swivel part.

10. The motor vehicle door lock according to claim 1, wherein the position element and the actuator are movable relative to each other.

11. The motor vehicle door lock according to claim 1, wherein the position element is a lever that directly engages the sensor.

12. The motor vehicle door lock according to claim 1, wherein the additional spring interacts with the raising mechanism.

13. The motor vehicle door lock according to claim 1, wherein during a closing process, the at least one actuating spring and the additional spring are tensioned.

14. The motor vehicle door lock according to claim 13, wherein when the at least one actuating spring fails during the closing process, the additional spring enables the position element and the actuator to move toward each other, whereby the additional spring is relaxed.

15. The motor vehicle door lock according to claim 1, wherein the one spring leg and the another spring leg are connected to a common winding and extend from opposite sides of the common winding.

16. The motor vehicle door lock according to claim 1, wherein the one spring leg and the another spring leg are connected to a common winding, wherein the one spring leg and the other spring leg form an acute angle therebetween.

* * * * *